US005575087A

United States Patent [19]

Ehrhart et al.

[11] Patent Number: 5,575,087

[45] Date of Patent: Nov. 19, 1996

[54] SHOE, ESPECIALLY A MOCCASIN

[75] Inventors: Hans Ehrhart, Wasgaustrasse 29, D-76848; Peter Ehrhart, both of Schwanheim, Germany

[73] Assignee: Hans Ehrhart, Schwanheim, Germany

[21] Appl. No.: 190,147

[22] PCT Filed: Jun. 4, 1993

[86] PCT No.: PCT/DE93/00482

§ 371 Date: Mar. 24, 1994

§ 102(e) Date: Mar. 24, 1994

[30] Foreign Application Priority Data

Jun. 6, 1992 [DE] Germany ..... 42 18 805.9
Dec. 24, 1992 [DE] Germany ..... 42 44 147.1

[51] Int. Cl.[6] ..... A43B 3/14

[52] U.S. Cl. ..... 36/11; 12/142 MC

[58] Field of Search ..... 36/11, 57, 78, 36/17 R, 19 R, 21, 12, 18, 45; 12/142 MC, 142 D, 142 B, 142 C, 146 W

[56] References Cited

U.S. PATENT DOCUMENTS 1,656,565 1/1928 Lyon ..... 36/78
3,407,352 9/1946 Stritter ..... 36/17 R
4,034,431 7/1977 Fukuoka ..... 36/11
4,161,827 7/1979 Roberts et al. ..... 36/11

FOREIGN PATENT DOCUMENTS 8700298 7/1987 Germany .

*Primary Examiner*—Ted Kavanaugh
*Attorney, Agent, or Firm*—Max Fogiel

[57] ABSTRACT

A shoe with a shaft that encloses the front of the wearer's foot and is attached to a sole component. The upper section and lower section of the shaft and an inserted strip that extends along their outer edges in the vicinity of the attachment are attached along at least one hand-laced seam. The strip can be inserted between the edges of the sections of the shaft and can also overlap the edge of the lower section of the shaft. One embodiment includes a two-layer strip with two halves sewn together along the edge of an incision. This strip can be inserted as a whole or with only one half between the sections of the shaft. In the later event the second half of the strip will overlap the outside of the edge of the lower section of the shaft.

21 Claims, 8 Drawing Sheets

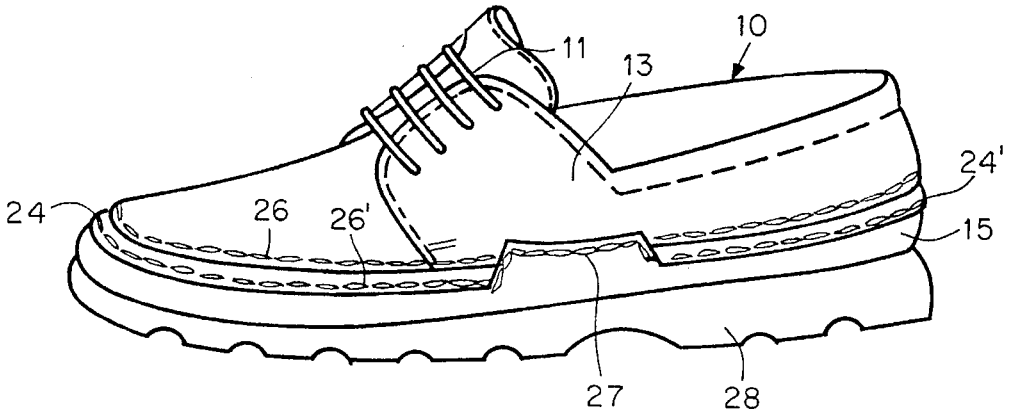
FIG. 1
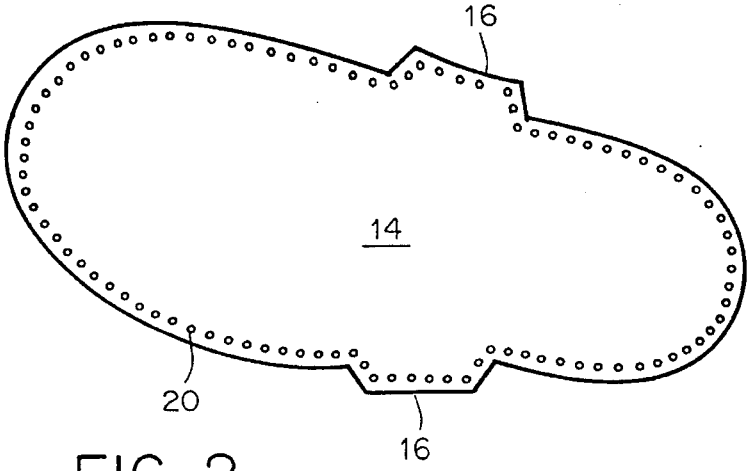
FIG. 2
FIG. 3
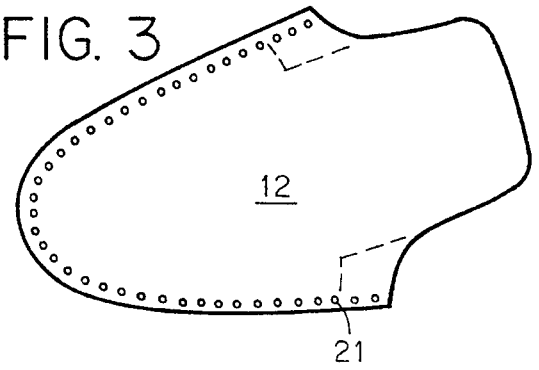

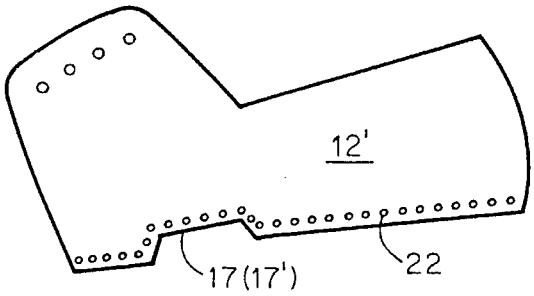
FIG. 4
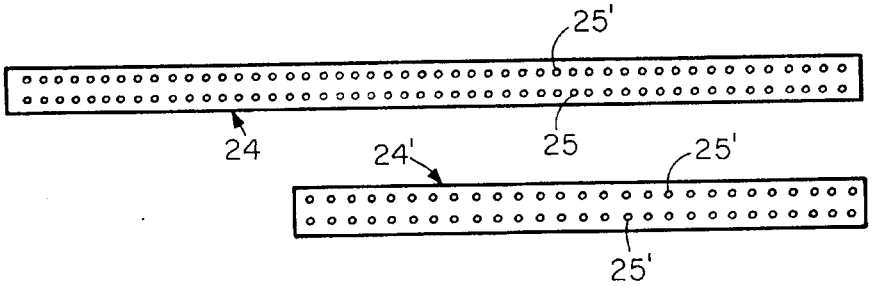
FIG. 5
FIG. 6
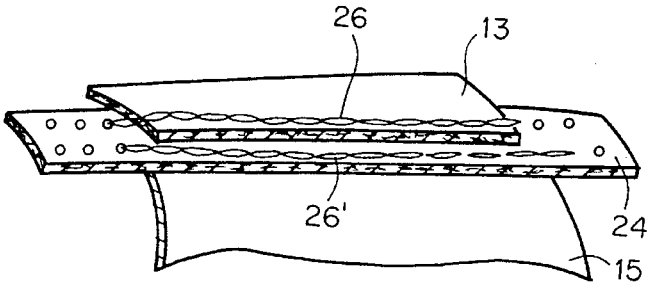
FIG. 7
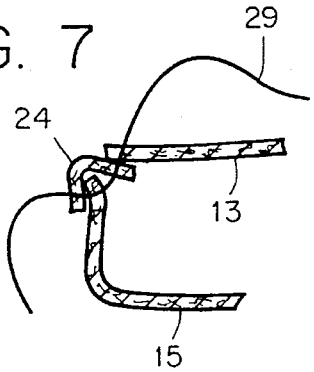

SHOE, ESPECIALLY A MOCCASIN

BACKGROUND OF THE INVENTION

The present invention concerns a shoe, especially a moccasin. The shoe has a shaft that completely encloses the front of the wearer's foot. The shaft is attached to a sole component. The invention concerns in particular a moccasin with a shaft that comprises an upper section sewn to a lower section. Moccasins of this type are already known. They are described for example in German OS 3 934 080.

The shoe described in that publication is a moccasin. It has a shaft with an upper section and a lower section. The lower section of the shaft provides a surface for the forward part of the wearer's foot to rest on and is sewn to the upper section. The bottom of the lower shaft section is cemented to the sole component. The lower shaft section is an insert that fits the shape of the front of the wearer's foot and is sewn to the upper section along a seam that follows the outer edge of the sole component. The outer edge of the upper shaft section extends all the way to the sole component and surrounds the insert that constitutes the lower shaft section and is cemented to the sole component.

Moccasins of the type described in the aforesaid publication have been demonstrated practical, although it is apparent that they could be produced with less material, especially with less upper leather.

SUMMARY OF THE INVENTION

One object of the present application is accordingly a shoe that can be made of less upper leather in particular as well as being particularly easy to manufacture.

This object is attained in accordance with the invention in a shoe where at least some sections of a strip are inserted between the upper section and the lower section of the shaft and in that the edges of the strip are overlapped by the adjacent edges of the upper and lower sections of the shaft and attached to them along at least one hand-laced or machine-sewn seam.

The upper section of the shaft in the shoe in accordance with the present invention consequently does not extend, like that in the shoe described in the aforesaid publication, all the way to the sole component. It is sewn to the inserted strip along an overlapping hand-laced seam, and the other edge of the strip is fastened to the lower section of the shaft by another overlapping hand-laced or machine-sewn seam.

A version of the shoe with the inserted strip fastened to the upper and lower section of the shaft along at least one hand-laced or machine-sewn seam with one edge behind the adjacent edge of the upper section of the shaft and the other edge in front of the corresponding edge of the lower section has been demonstrated practical.

When on the other hand the attachment of the inserted strip to the upper section of the shaft is intended to be emphasized, the inserted strip can be fastened to the upper and lower section of the shaft along at least one hand-laced or machine-sewn seam with one edge in front of the adjacent edge of the upper section of the shaft and the other edge behind the corresponding edge of the lower section.

Depending on the intended style, the inserted strip attached to the upper and lower sections of the shaft along at least one hand-laced seam can be present only at certain locations, and the two sections of the shaft can be attached together directly at other locations, preferably again along at least one hand-laced or machine-sewn seam.

The inserted strip in one sensible advanced version of the invention is continuous, at least in the vicinity of the front of the wearer's foot, and is fastened to the upper and lower sections of the shaft along at least one hand-laced or machine-sewn seam. The inserted strip can also or alternatively extend all the way around the heel.

The inserted strip attached to the upper and lower sections of the shaft along at least one hand-laced or machine-sewn seam in another important embodiment of the invention can be a straight blank longer than it is wide. It will be obvious that an inserted strip of this type will save a great deal of material and accordingly money.

The inserted strip attached to the upper and lower sections of the shaft along at least one hand-laced or machine-sewn seam can alternatively be a blank shaped like the outer edge of the upper and/or lower section of the shaft.

The seams where the upper and lower sections of the shaft are attached to the inserted strips in another important embodiment of the invention can be laced up through rows of holes punched through the overlapping edges of the strip and of the two shaft sections.

It is, however, also possible within the scope of the invention for one row of holes to extend along only one edge of the inserted strip and for the lace that attaches the inserted strip to the two sections of the shaft to extend through holes in the aforesaid row, through holes in a row in the adjacent edge of the adjacent section of the shaft and around the other edge of the strip, and through holes in still another row along the adjacent edge of the other section of the shaft.

The lace that attaches the inserted strip to the upper and lower sections of the shaft in still another embodiment, finally, extends in order through holes in a row along one edge of the strip and along the overlapping edge of one section of the shaft, around the other edge of the strip and through holes in a row extending along the adjacent edge of the other section of the shaft and intermediately through holes in a row extending along the edge of the strip towards the latter edge of the strip.

The inserted strip that is attached to the upper and lower sections of the shaft along at least one laced seam can alternatively extend within the scope of the invention beyond the edge of the lower section of the shaft and, in one advanced version, as far as the sole and be cemented to the sole component. The strip that is attached to both the upper and lower section of the shaft in this embodiment along at least one hand-laced seam will be wrapped around the lower edge of the lower section of the shaft that faces the sole. The lower section of the shaft and the inserted strip will accordingly be in two layers in this area.

It has furthermore been demonstrated practical for the edge of the upper section of the shaft that is attached to the edge of the inserted strip along at least one hand-laced seam to extend at a distance from the lower edge of the strip or from a sole component that is cemented to the lower section of the shaft such that the strip will be more or less extensively emphasized depending on whether the strip overlaps or is overlapped by one of the shaft sections and on the design of the hand-laced seam between the strip and the shaft section.

The raw edges of the shaft sections that constitute their outer edges in the vicinity of the front of the wearer's foot in still another advanced version of the invention can be joined to at least one raw edge of the inserted strip toward the side facing away from the sole component and attached by at least one hand-laced or machine-sewn seam.

Due to the raw edges that extend toward the side facing away from the sole component and the edges of the aforesaid shaft section and inserted strip, an emphatic ridge all the way around the edge in the vicinity of the laced seam where the upper section of the shaft is attached to the lower section is characteristic of this embodiment. This means of attaching the shaft sections together and to the inserted strip along at least one hand-laced seam allows particularly simple and rapid and accordingly cost-effective shoe manufacture.

This is especially true when, as in another advanced version, the strip is inserted between the elevated edge of the upper section of the shaft that faces away from the sole component and the edge of the lower section of the shaft.

The elevated edge of the upper section of the shaft that faces away from the sole component in still another advanced version can on the other hand rest directly against the edge of the lower section of the shaft, the outside of which is accordingly overlapped by the inserted strip. The raw edge of the lower section of the shaft will in this version as well face the edge facing away from the sole component, although it will be invisible due to the inserted strip overlapping the outside of the edge of the lower section of the shaft.

It is also possible to employ an inserted strip that is at least partly in two layers instead of a simple inserted strip of leather with a row of holes, whereby two halves are laid together surface to surface and essentially congruent and sewn together along one raw edge.

It has been demonstrated practical when the strip is two-layered to insert it with the seam where its halves are attached together facing the side that faces away from the sole between the elevated edge of the upper section of the shaft and the edge of the lower section of the shaft. In this event the two layers of the strip sewn in between the edge of the lower section of the shaft and that of the upper section of the shaft will produce an especially emphatic continuous ridge around the edge where the two sections of shaft are attached.

A two-layer strip can, as in the embodiments hereintofore discussed in conjunction with a one-layer strip, be inserted with one half between the elevated edge of the upper section of the shaft and the edge of the lower section of the shaft and the other half overlapping the outside of the edge of the lower section of the shaft that is attached to the edge of the upper section of the shaft along the side facing away from the upper section of the shaft. In this event the seam along the edges of the two layers of the strip will extend along the side facing away from the sole component and the seam will again be in the form of a continuous emphatic ridge.

In still another advanced version of the invention that employs a two-layer strip finally, the ends of one half can have rows of holes and project beyond the other half and the shorter half can be accommodated between the elevated edge of the upper section of the shaft and the edge of the lower section of the shaft. The longer half can overlap the edge of the lower section of the shaft with its ends extending to the end of incisions separating the lower section of the shaft from flaps notched into them and attached to the edges of the incisions along at least one hand-laced seam.

Another object of the invention concerns a shoe that is not a moccasin. At least some sections of the inserted strip in this embodiment are attached to the shaft along the outer edge and to the sole component along at least one hand-laced seam.

BRIEF DESCRIPTION OF THE DRAWINGS

Various embodiments of the present invention will now be specified with reference to the accompanying schematic drawing, wherein FIG. 1 is a lateral perspective view of a moccasin with laces, FIG. 2 illustrates a blank for a one-piece lower section of a shaft, FIG. 3 a blank for an upper section of a shaft associated with the front of the wearer's foot, FIG. 4 a blank for an upper section of a shaft associated with the midsection and heel area of the wearer's foot, and FIG. 5 two inserted strips of different lengths, FIG. 6 is a partly sectional perspective view illustrating how an inserted strip is attached at hand-laced seams to the overlapping edge of the upper section of the shaft and to the overlapped edge of the lower section of the shaft, FIG. 7 illustrates one possible form of the attachment of an inserted strip to the edges of the lower and upper section of the shaft illustrated in FIG. 6.

DESCRIPTION OF THE PREFERRED EMBODIMENTS

Figure 8:
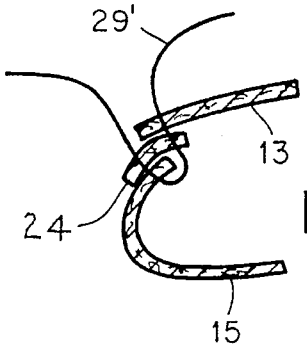
FIG. 8 is a view similar to that in FIG. 7 of another form of attachment between an inserted strip and the edges of the upper and lower sections of the shaft.

The entire moccasin 10 is illustrated in FIG. 1. It has laces 11. The upper section 13 of the shaft is made from two blanks 12 and 12'. The lower section 15 of the shaft is made from a single blank 14. FIG. 2 illustrates blank 14, and FIGS. 3 and 4 blanks 12, which constitutes the area of the upper section 13 of the shaft associated with the front of the foot, and 12', which constitutes the area at the heel.

As will be especially evident from FIG. 2, the blank 14 for the lower section 15 of the shaft has more or less in the midsection of the foot two opposite tabs 16 and 16' extending part-way along the lower section, whereas the blank 12' for the area of the upper section 13 of the shaft associated with the wearer's heel has matching indentations 18 and 18' along its lower edge 18. The blank 14 for the lower section 15 of the shaft and the blank 12 for the area of the upper section 13 of the shaft associated with the front of the wearer's foot have rows 20 and 21 of holes along their outer edges. The blank 12' for the area of the upper section 13 of the shaft associated with the wearer's heel has a row 22 of holes along its lower edge. These holes also extend past the indentations 17 and 17' that accommodate the tabs 16 and 16' on each side of the blank 14 for the lower section 15 of the shaft.

The upper and lower sections 13 and 15 of the shaft of the moccasin 10 illustrated in FIG. 1 are attached with the strips 24 and 24' illustrated in FIG. 5 between them. Inserted strips 24 and 24' have rows 25 and 25' along their edges. The sections are attached to the strips at hand-laced seams 26 and 26'. The tabs 16 and 16' that project out from each side of the blank 14 for the lower section 15 of the shaft are laced to the indentations 17 and 17' in the bottom of the blank 12' for the area of the upper section 13 of the shaft associated with the wearer's heel at a hand-laced seam 27. Inserted strips 24 and 24' extend all the way up to these tabs, which are attached directly to the upper section of the shaft at hand-laced seams. One strip extends all the way around the front of the wearer's foot and the other all the way around the heel.

FIG. 1 also illustrates how moccasin 10 is provided with a sole component 28. Sole component 28 is attached to the lower section of the shaft in accordance with known procedures by cementing once the upper section 13 of the shaft has been laced to the lower section 15 of the shaft with inserted strips 24 and 24' between them.

FIG. 6 is a larger-scale detail of the area in FIG. 1 illustrating how inserted strip 24 is attached to the upper and lower sections 13 and 15 of the shaft by hand-laced seams 26 and 26'. The edge of the upper section 13 of the shaft overlaps one lateral edge of inserted strip 24. The other lateral edge of inserted strip 24 in turn overlaps the adjacent edge of lower section 15 of the shaft. The upper and lower sections 13 and 15 of the shaft and inserted strip 24 are all provided as will be evident from FIGS. 2 through 5 with a row of holes along the edges that are to be attached together and are attached at the two essentially parallel seams 26 and 26' by a lace that is laced through the holes in the associated rows in the edges of the strip and of the sections of shaft.

As will be evident from FIG. 7, the strip 24 inserted between the upper and lower sections 13 and 15 of the shaft can also be attached to both sections at a seam with a continuous thread 29 that extends through the holes in the rows along the overlapping edges of inserted strip 24 and of the lower section 15 of the shaft and through the holes in the row along the other end of the strip and the holes in the row along the overlapping edge of the upper section 13 of the shaft. It will be evident that, in the method of attaching inserted strip 24 to the upper and lower sections 13 and 15 of the shaft illustrated in FIG. 7, the strip will appear in the form of a highly emphasized ridge in that the edge of the strip that overlaps the edge of the lower section of the shaft is laced to the edge of the upper section of the shaft with the other lateral edge of the strip between them.

FIG. 8 illustrates another way of attaching the upper section 13 to the lower section 15 of the shaft with an inserted strip 24 between them. One edge of the strip is again overlapped by the edge of the upper section of the shaft and its other lateral edge overlaps the lower section of the shaft. The aforesaid components are in the embodiment illustrated in FIG. 8 as well attached at a hand-laced seam produced with a continuous thread 29'. The edge of the lower section 15 that joins inserted strip 24 wraps in toward the upper section of the shaft. The thread that produces the seam extends into the shoe through the holes in the edge of the lower section of the shaft and the lateral edge of the inserted strip overlapping them. Inside the shoe the thread wraps around the edge of the lower section of the shaft and is then laced through the coinciding holes in the rows in the other edge of the inserted strip and in the adjacent edge of the upper section 13 of the shaft.

Figure 9:
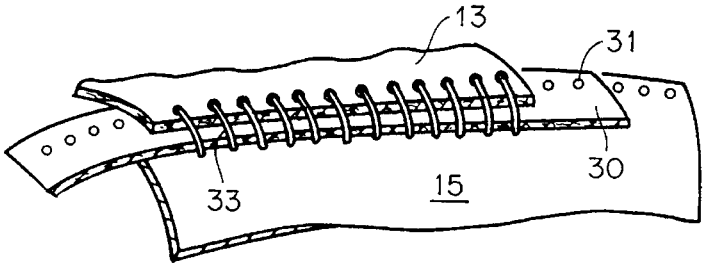
FIGS. 9 and 10 are views similar to those in FIGS. 6 and 7 of an attachment between an inserted strip and the edges of the upper and lower sections of the shaft by means of a laced wrapped around the edge of the lower section of the shaft.
Figure 10:
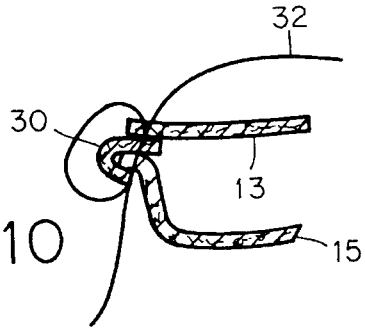

FIGS. 9 and 10 illustrate how the upper section 13 of the shaft can be attached to lower section 15 by way of an inserted strip 30 with a row 31 of holes distributed along only the lateral edge overlapped by the upper section of the shaft at a hand-laced seam 33 produced by a continuous thread 32. As will be particularly evident from FIG. 10, thread 32 is laced through the holes of coincident rows of holes along one edge of inserted strip 30 and along the edge of the upper section 13 of the shaft that overlaps it. The thread is then wrapped around the edge of the inserted strip that overlaps the edge of the lower section 15 of the shaft before threading through the next-following holes.

In this type of attachment as well, as in the embodiment illustrated in FIG. 7, the edge of the lower section 15 of the shaft overlapped by a lateral edge of inserted strip 30 is directly attached to the edge of the upper section 13 of the shaft with the edge overlapped by that edge between them and wrapped outward and secured by the other edge of the inserted strip. The loops of thread are all wrapped tight around this edge of the inserted strip. The inserted strip wrapped in a U around the outward-facing edge of the lower section of the shaft will accordingly constitute an emphatic ridge.

Figure 12:
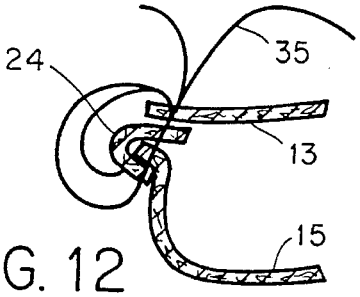
FIGS. 11 and 12 are also views similar to those in FIGS. 6 and 7 illustrating the attachment of an inserted strip to the edges of the upper and lower sections of the shaft at still another type of hand-laced seam.
Figure 11:
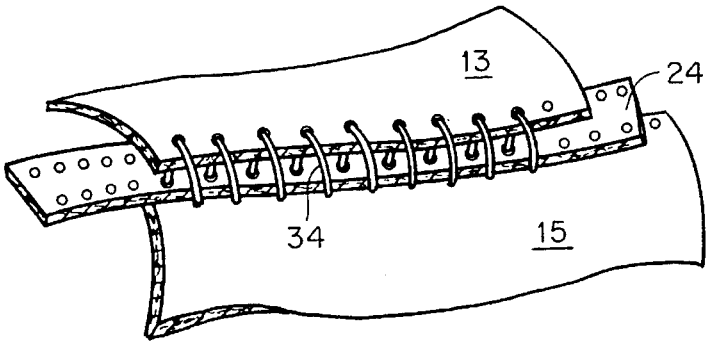

The embodiment illustrated in FIGS. 11 and 12 differs from the one illustrated in FIGS. 9 and 10 in that the inserted strip 24 has rows 25 of holes along each lateral edge and by the structure of hand-laced seam 34. As in the embodiments hereintofore specified, the edge of the upper section 13 of the shaft overlaps on lateral edge of inserted strip 24 and its other edge the adjacent edge of the lower section 15 of the shaft. The seam 34 that joins these component is again produced by a continuous thread 35. Thread 35 is threaded through each hole in the row along one lateral edge of the inserted strip and through the coincident holes in the adjacent edge of the upper section of the shaft, but otherwise laced alternately through one of the holes in the other edge of the inserted strip and in the edge of the lower section of the shaft, wrapped once around the edge of the inserted strip at the lower section of the shaft.

It is typical of the hand-laced seam 34 illustrated in FIGS. 11 and 12 that in contrast to the embodiment illustrated in FIGS. 9 and 10 only every other loop wraps around the edge of inserted strip 24 that overlaps the edge of the lower section 15 of the shaft. The intermediate loops are laced through the holes in the row in the edge of the inserted strip at the lower section of the shaft. Also characteristic of this embodiment is the particularly emphatic ridge constituted by the inserted strip as illustrated in FIG. 12.

Figure 13:
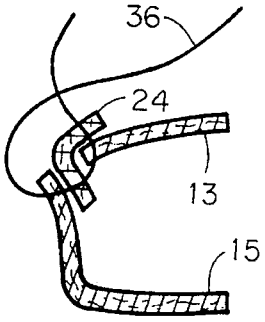
FIGS. 13 through 15 are views like that in FIG. 7 illustrating various possible embodiments of hand-laced seams between an inserted strip and the edges of the upper and lower sections of the shaft.
Figure 14:
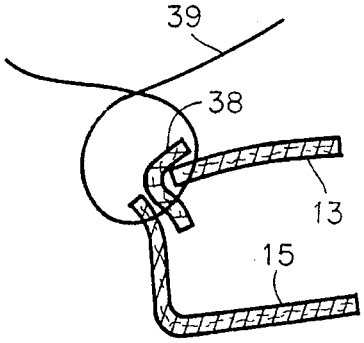
Figure 15:
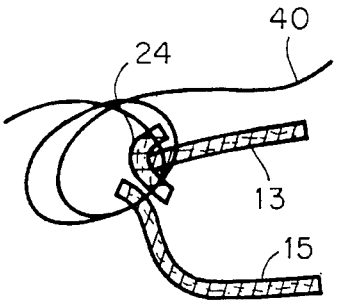

The possible embodiments illustrated in FIGS. 13 through 15 differ from the embodiments specified hereintofore in that the outside of the edge of the upper section of the shaft has a row of holes and is overlapped by one edge of the inserted strip and the other edge of the lower section of the shaft also has a row of holes and overlaps the outside of the other lateral edge of the inserted strip.

The inserted strip 24 in the embodiment illustrated in FIG. 13 also has rows of holes along both lateral edges and joins the upper and lower sections 13 and 15 of the shaft at a seam produced by a continuous thread 36. Thread 36, like the thread in the embodiment illustrated in FIG. 7 is laced in order through the holes in the overlapping edges of the inserted strip and shaft sections but is not wrapped around the outside of the inserted strip.

The inserted strip 38 in the embodiment illustrated in FIG. 14 has only one row of holes. The holes are distributed along the lateral edge overlapped by the edge of the lower section 15 of the shaft. The strip is attached to the shaft sections by a hand-laced seam. A thread 39 is laced through the holes in the edge of the lower section of the shaft and in the edge of the inserted strip overlapped thereby as well as through holes in a row along the edge of the upper section of the shaft and is then threaded around the outside of each edge of the inserted strip that overlaps the adjacent edge of the upper section of the shaft. The hand-laced seam is accordingly similar to the one hereintofore specified with reference to FIGS. 9 and 10 with the exception that the edge of the blank for the strip 38 overlapping the edge of the upper section 13 of the shaft is visible on the outer surface of the upper section of the shaft.

The embodiment illustrated in FIG. 15 is similar to the one illustrated in FIGS. 11 and 12 with the exception that, as in the embodiment illustrated in FIG. 14, the edge of the blank for the strip 24 overlapping the edge of the upper section 13 of the shaft is visible. Furthermore, the thread 40 that produces the hand-laced seam is laced through alternate holes in the overlapping edges of inserted strip 24 and the upper section 13 of the shaft.

Figure 16:
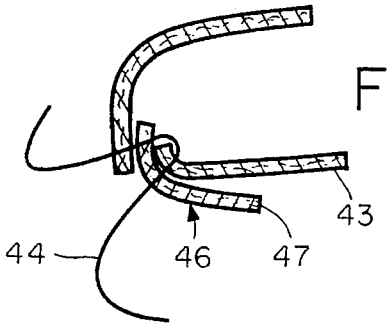
FIG. 16 is a view like that in FIGS. 13 through 15 illustrating the use of an inserted strip attached to the upper and lower sections of the shaft at a hand-laced seam and wrapped around the lower section of the shaft and extending as far as the sole area of the lower section of the shaft, which is to be attached to the sole component.
Figure 17:
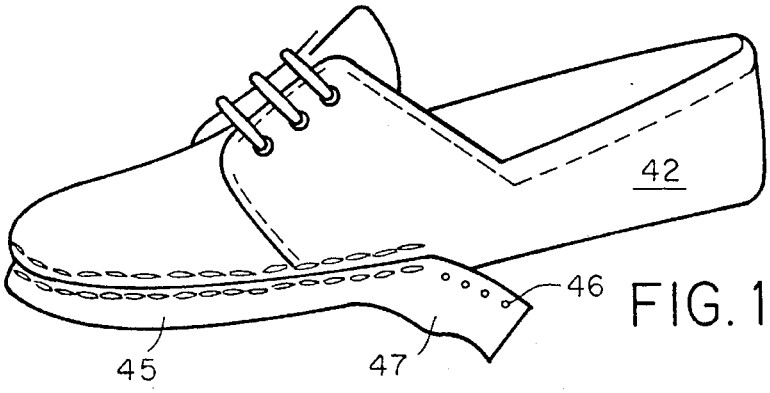
FIG. 17 is a lateral perspective view like that in FIG. 16 of the upper section of the shaft with an inserted strip attached to it at a hand-laced seam and to the lower section of the shaft, whereby the inserted strip is wrapped around the lower section of the shaft, invisible from this angle, and extends to the vicinity of the sole.

The strip 46 in the embodiment illustrated in FIGS. 16 and 17 is considerably wider than the strips in the embodiments hereintofore specified. Strip 46 is inserted between the upper section 42 and the lower section 43 of the shaft. Strip 46 is attached to them at a hand-laced seam 45 produced by a continuous thread 44. The lower section 43 of the shaft in this embodiment extends essentially only over the vicinity of the sole. A row of holes is distributed along the edge of lower section 43. The edge is folded up out of the plane occupied by the vicinity of the sole. The upper section 42 of the shaft extends almost to the aforesaid vicinity of the sole. Strip 46 has two rows of holes and is inserted between the upper and lower sections of the shaft. It is overlapped by an edge of the upper section of the shaft that is provided with a row of holes. The remaining area of the inserted strip is wrapped around and overlaps the outside of the lower section of the shaft and extends down to the vicinity of the sole.

Inserted strip 46 is again attached to the upper section 42 and the lower section 43 of the shaft at a hand-laced seam 45 produced by a continuous thread 44. Thread 44 is, like the thread in the embodiment illustrated in FIG. 7, laced in order through the holes in the overlapping edges of strip 46 and shaft sections 42 and 42'. FIG. 17 is a perspective view illustrating an inserted strip 46 laced at the front of the wearer's foot to the upper section 42 of the shaft and to the unillustrated the lower section of the shaft. A margin 47 extends beyond the row of holes in the lower section of the shaft and wraps around the edge of the lower section 43 of the shaft as illustrated in FIG. 18, extending as far as the sole.

Figure 18:
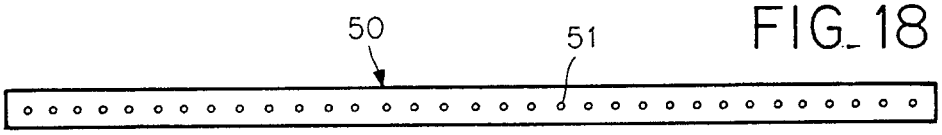
FIG. 18 illustrates an inserted strip with a continuous row of holes.

The inserted strip 50 illustrated in FIG. 18 constitutes a narrow blank with a continuous row 51 of holes for sewing it to the edges of the upper and lower shaft sections of a moccasin at a continuous laced seam.

Figure 19:
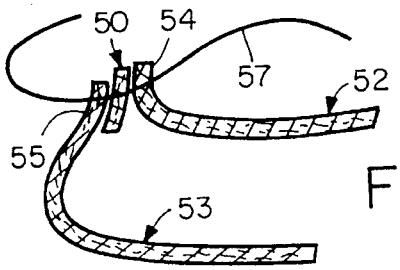
FIG. 19 is a section illustrating the attachment of the upper and lower sections of the shaft to a strip like that illustrated in FIG. 18 inserted between their edges.

FIG. 19 is a schematic section illustrating the at-the-edge attachment of the upper section 52 of the shaft to a lower section 53 with a strip 50 inserted between them. The vicinity 54 of the edge of upper section 52 of the shaft, which is shell cordovan, is folded up, and its outer raw edge constitutes in conjunction with the also upward-facing raw edge 55 around the lower section 43 of the shaft and that of strip 50 an emphatic ridge, whereby the edges of the two shaft sections and the inserted strip have coincident holes, and are attached at a continuous hand-laced seam. FIG. 19 illustrates a thread from hand-laced seam 57.

Figure 20:
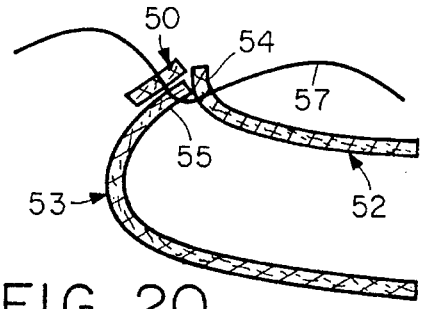
FIG. 20 is a view like that in FIG. 19 illustrating the attachment of the edges of the upper and lower shaft sections with a strip applied to the outside of the edge of the lower section of the shaft.
Figure 21:
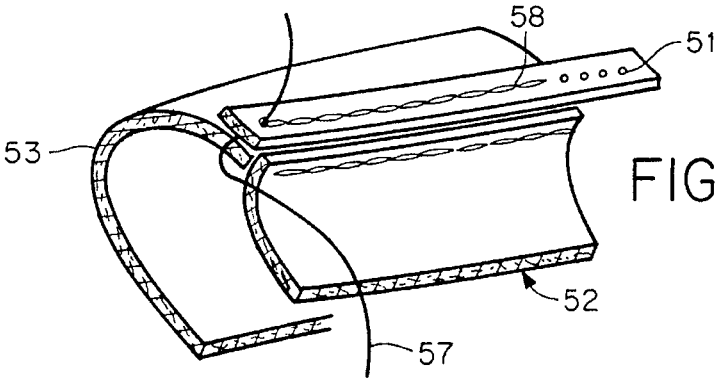
FIG. 21 is a perspective view of the attachment illustrated in FIG. 20.

The strip 50 illustrated in FIG. 20 is the same as the strip 50 illustrated in FIG. 18. The edges 54 and 55 of the upper section 52 and lower section 51 and of the strip illustrated in FIG. 20 are supplied with continuous rows of coincident. They are attached as indicted by a lacing thread 57 to each other and to strip 50, which rests against the outside of the lower section of the shaft. The continuous ridge, which is likewise in the vicinity of the seam between the lower and the upper section of the shaft is constituted in this embodiment by the upright raw edge of the upper section 52 of the shaft and one raw edge of strip 50. The outer edge of the blank of the lower 53 section of the shaft is masked by the inserted strip and by the raised edge of the upper section of the shaft. The perspective detail in FIG. 21 illustrates how the seam with the superimposed strip illustrated in FIG. 20 can be accomplished with a continuous hand-laced seam 58.

Figure 22:
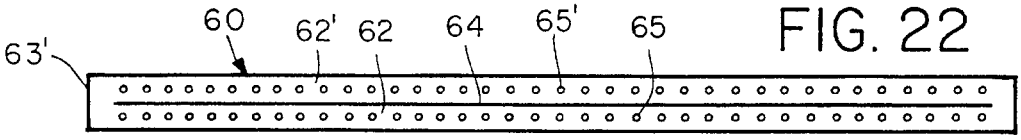
FIG. 22 illustrates a blank for an strip with two rows of holes and with a longitudinal slit extending almost to each end.
Figure 23:
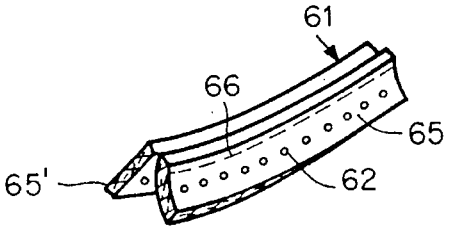
FIG. 23 is a perspective view of part of a strip produced from the blank illustrated in FIG. 22 by folding it coincident with the slit and sewing it together.

FIG. 23 illustrates an inserted strip 61 made from the blank 60 illustrated in FIG. 22. The blank illustrated in FIG. 23 is approximately twice as wide as the blank illustrated in FIG. 18, features two parallel and separated rows 62 and 62' of holes, and is divided into two similar halves 65 and 65' by an incision that extends almost to each end 63 and 63'. The bland is folded along the line and sewn along a continuous machine-sewn seam 66 as illustrated in FIG. 23. The halves on each side of the incision can rest against each other flat or in the form of a V with its base along seam 66.

Figure 24:
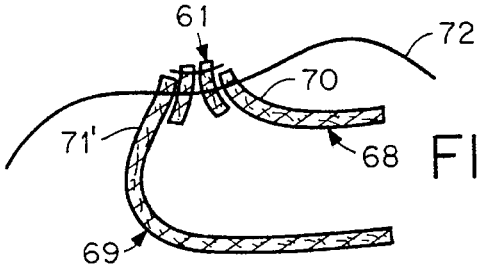
FIG. 24 is a view like that in FIG. 19 illustrating the attachment between the upper and lower shaft sections with an insert like that illustrated in FIG. 23 between them.

The attachment between the upper section 68 and the lower section 69 of the shaft illustrated in FIG. 24 is similar to the attachment illustrated in FIG. 18. Instead of the slender strip illustrated in FIG. 18 however, the strip 61 illustrated in FIG. 23 is folded in two along an incision 64 and joined along a machine-sewn seam 66. The edges 70 and 71 of the upper and lower shaft sections are provided with rows of holes. Strip 61 is inserted between them and the edges of the shaft sections are joined along a hand-laced seam produced by a lacing thread 72.

Figure 25:
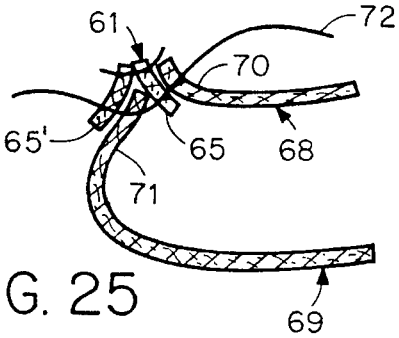
FIG. 25 is a view like that in FIG. 20 illustrating the attachment between the upper and lower shaft sections with one half of the strip illustrated in FIG. 23 between them and the other half overlapping the edge of the lower section of the shaft.

The attachment between the upper section 68 and the lower section 69 of the shaft illustrated in FIG. 25 is similar to the embodiments illustrated in FIGS. 19 and 20 in that one half 65 of the strip 61 illustrated in FIG. 23 is inserted between the edges 70 and 71 of the shaft sections and the other half 65 overlaps the edge 71 of the lower section 69 of the shaft. Rows of holes are distributed along the edges of the shaft sections and of the strip. The edges are again joined along a hand-laced seam produced by a lacing thread 72.

Figure 26:
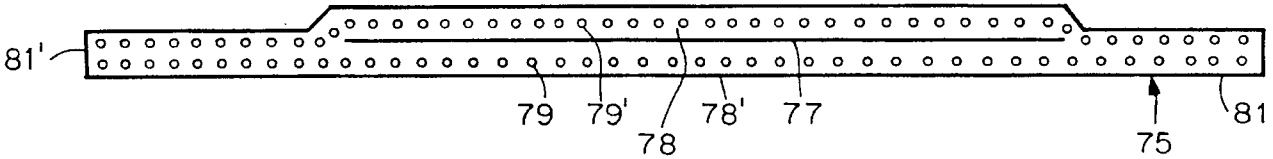
FIG. 26 is a view like that in FIG. 22 of a blank for a strip with a longitudinal slit along its midline.

FIG. 26 illustrates another blank 75 for an inserted strip 76. It differs from the blank illustrated in FIG. 22. The midsection of the blank is divided into two halves 78 and 78' by a longitudinal incision 77. A row 79 and 79' of holes is distributed along each. A narrower section 80 and 80' extends out from each end of the midsection. Row 79 continues over narrower sections 80 and 80'. Another row 81 and 81' of holes, more or less aligned with incision 77 is distributed paralleling row 79 along the narrow sections. This particular inserted strip is intended for use in conjunction with the blank 84 for the lower section 86 of the shaft illustrated in FIG. 27 and the blank 85 for the upper section 87 of the shaft illustrated in FIG. 28 to manufacture the moccasin 88 illustrated in FIG. 29.

Figure 27:
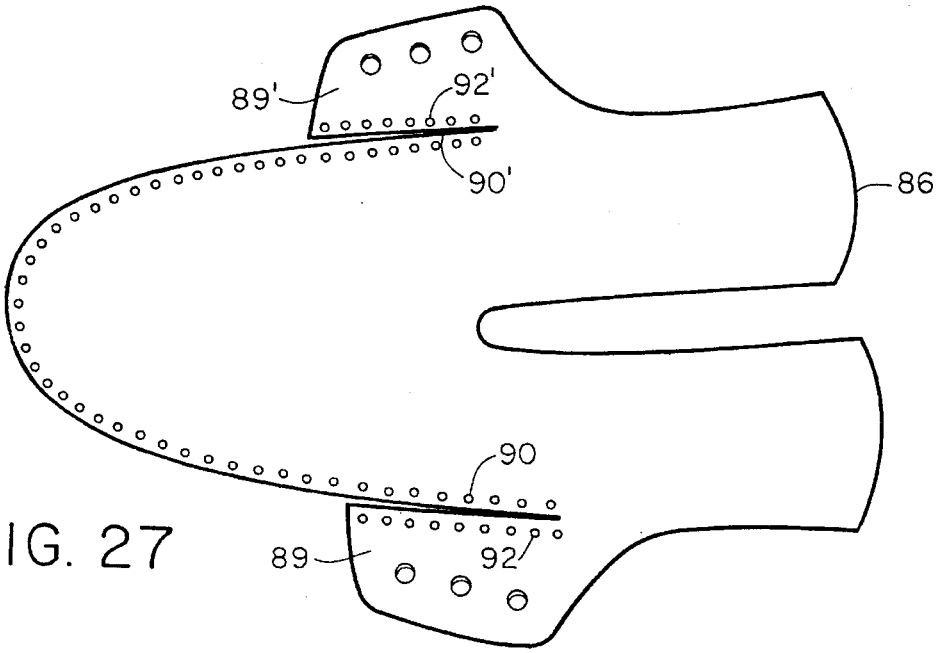
FIG. 27 illustrates a blank for a one-piece lower section of the shaft, FIG. 28 a blank for the upper section of the shaft.

The lower section 86 of the shaft illustrated in FIG. 27 is from a one-piece blank with flaps 89 and 89' cut out of it. The area of flaps 89 and 89' toward the front of the wearer's foot are separated from the area of the lower section of the shaft associated with the wearer's foot by incisions 90 and 90' that continue the contour of the latter area. A row 91 of holes is distributed along the edge of the area of the blank associated with the front of the wearer's foot and extends into the vicinity of incisions 90 and 90'. Rows 92 and 92' of holes are distributed along the edge of the flaps on the other side of the incision.

Figure 28:
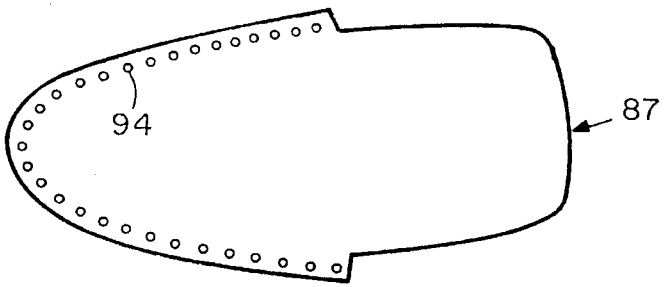

The blank for the upper section of the shaft illustrated in FIG. 28 matches the blank for the lower section of the shaft illustrated in FIG. 27. A row 94 of holes is distributed along the outer edge of the area associated with the front of the wearer's foot.

Figure 29:
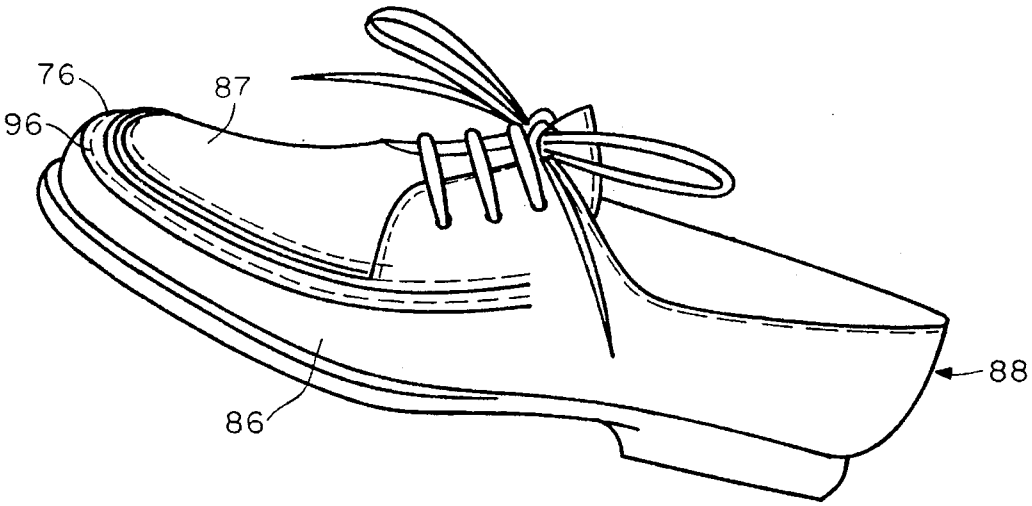
FIG. 29 is a lateral perspective view of a laced shoe manufactured from the blanks illustrated in FIGS. 26 through 28.

The shaft sections 86 and 87 illustrated in FIGS. 27 and 28 are sewn along with an inserted strip 76 obtained from the blank 75 illustrated in FIG. 26 into the moccasin illustrated in FIG. 29 along a continuous hand-laced seam 96. The strip is produced like the one illustrated in FIG. 23 by folding the two halves 78 and 78' of the blank illustrated in FIG. 26 together along the longitudinal incision 77 that separates them and joining them at a machine-sewn seam along the outer edges of the incision as illustrated in FIG. 23. A row of holes is distributed along the edge of the upper section of the shaft. The strip is sewn to the edges of the upper and lower shaft sections by inserting shorter half 78', which is as long as the outer edge of the upper section of the shaft, between the upper and lower shaft sections, whereas the other half, which the two narrower sections 80 and 80' extend out of, continues in the vicinity of the incisions 90 and 91' that follow the outer edge of the lower section of the shaft between the area of the lower section of the shaft associated with the front of the wearer's foot and flaps 89 and 89' and are secured by a lace that is threaded through the holes in the rows that parallel the aforesaid incision and simultaneously attaches the flaps separated from the rest of the lower section of the shaft by the aforesaid incisions.

Figure 30:
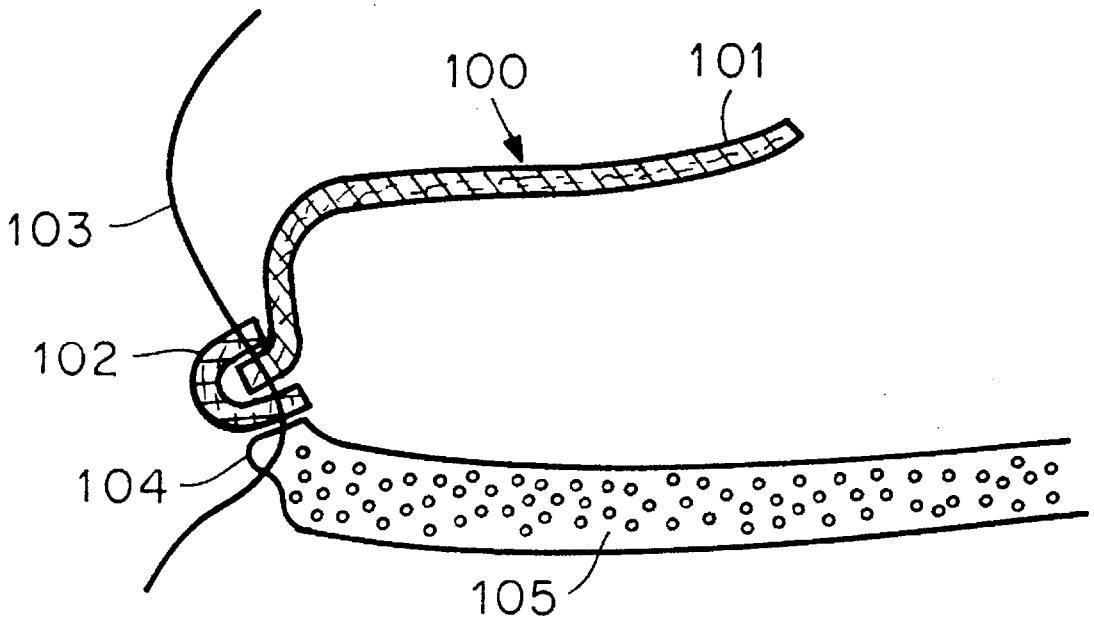
FIG. 30 is a view like that in FIG. 16 of a shoe with an inserted strip attached not only to the outer edge of the shaft but also to the outer edge of the sole component at a hand-laced seam.

The embodiment illustrated in FIG. 30 is an opanke 100. It has a shaft 101. Shaft 101 is attached along its outer edge to the edge 104 of a sole component 105 with one edge of a narrow strip 102 inserted between them along a hand-laced seam produced by a continuous thread 103. The edge of shaft 101 is folded out and enclosed by strip 102, which constitutes a vamp, with the other edge of the strip accommodated between the edges of the shaft and of the sole component. A lacing thread is laced through holes in rows distributed along the edges of sole component 105 and shaft 101 and on each side of strip 102. The strip 102 in this embodiment constitutes a continuous vamp immediately above the edge 104 of sole component 105.

Furthermore, the inserted strip 46 that is attached to the upper section 42 and the lower section of the shaft along at least one hand-laced seam 45 and extends beyond the edge of the lower section of the shaft, also extends as far as the sole and is cemented to the sole component.

We claim:

1. A moccasin shoe comprising: a shaft enclosing a front portion of a wearer's foot; a sole attached to said shaft; said shaft comprising an upper part, a lower part, and at least one insert in form of a strip; said strip having at least sections located between said upper part and said lower part and sewn to said upper part and said lower part; said insert having a plurality of perforations along at least one longitudinal edge and comprising a strip-shaped blank having at least some straight sections, said strip having a length and a width so that the length exceeds the width; said insert and said upper part and said lower part of said shaft being tightly fastened together by at least one manually-laced seam; a lace attaching said strip to said upper part and said lower part of said shaft and extends in order through holes in a row along one edge of said strip and along an overlapping edge of one said part of said shaft and then alternating around another edge of said strip and through holes in a row extending along an adjacent edge of the other part of the shaft and intermediately through holes in a row extending along said another edge of the strip towards said adjacent edge of the strip.

2. A shoe as defined in claim 1, wherein said at least one edge with said perforations overlap lateral longitudinal edges of said insert.

3. A shoe as defined in claim 1, wherein said insert has one lateral longitudinal edge overlapping an edge of one said part of said shaft.

4. A shoe as defined in claim 1, wherein said strip is fastened to said upper part and said lower part of said shaft along at least one seam with one edge behind an adjacent edge of the upper part of said shaft and another edge in front of the corresponding edge of said lower part.

5. A shoe as defined in claim 1, wherein said strip is fastened to said upper part and said lower part of said shaft along at least one hand-laced seam with one edge in front of an adjacent edge of the upper part of said shaft and another edge behind the corresponding edge of the lower part.

6. A shoe as defined in claim 1, wherein said strip is continuous, at least adjacent to the front portion of the wearer's foot, and is fastened to the upper part and the lower part of said shaft along at least one hand-laced seam.

7. A shoe as defined in claim 1, wherein said strip extends entirely around a heel and is fastened to said upper part and said lower part of said shaft along at least one hand-laced seam.

8. A shoe as defined in claim 1, wherein said strip is attached to said upper part and said lower part of said shaft along at least one hand-laced seam and is a straight blank having a width and a length exceeding said width.

9. A shoe as defined in claim 1, wherein said strip is attached to the said upper part and said lower part of said shaft along at least one seam and is shaped corresponding to an outer edge of said upper part and said lower part of the shaft.

10. A shoe as defined in claim 1, wherein said upper part and said lower part of said shaft are attached to said strip by seams laced up through rows of holes punched through overlapping edges of said strip and of said two parts of said shaft.

11. A shoe as defined in claim 1, wherein a first row of holes extends along only one edge of said strip; a lace attaching said strip to said two parts of said shaft extends through said holes in said row as well as through adjacent holes around another edge of said strip.

12. A shoe as defined in claim 1, wherein said strip is attached to said upper part and said lower part of said shaft along at least one hand-laced seam and extends beyond an edge of said lower part of said shaft.

13. A shoe as defined in claim 12, wherein said strip that attached to said upper part and said lower part of said shaft along at least one hand-laced seam and extends beyond an edge of said lower part of the shaft also extends as far as a sole and is cemented to a sole component.

14. A shoe as defined in claim 1, wherein an edge of an upper part of said shaft is attached to an edge of said strip along at least one hand-laced seam and extends at a distance from a sole component cemented to said lower part of said shaft.

15. A shoe as defined in claim 1, wherein said shaft parts have raw edges comprising outer edges adjacent a front portion of a wearer's foot and are joined to at least one raw edge of said strip toward a side facing away from a sole component.

16. A shoe as defined in claim 15, wherein said strip is inserted between an elevated edge of said upper part of said shaft facing away from said sole component and an edge of said lower part of the shaft.

17. A shoe as defined in claim 15, wherein an elevated edge of said upper part of the shaft facing away from said sole component rests directly against an edge of said lower part of the shaft, said shaft having an outside overlapped by said strip.

18. A shoe as defined in claim 1, wherein said strip has at least partly two layers comprising two halves laid and attached together surface-to-surface and substantially congruent and sewn together along one raw edge.

19. A shoe as defined in claim 18, wherein said two-layered strip is inserted with a seam where said halves are attached together facing a side that faces away from said sole component between an elevated edge of a upper part of the shaft and an edge of said lower part of the shaft.

20. A shoe as defined in claim 18, wherein said two-layered strip is inserted with one half between an elevated edge of said upper part of the shaft and an edge of said lower part of the shaft and another edge overlapping an outside of said edge of said lower part of the shaft attached to said edge of said upper part of the shaft along a side facing away from said upper part of the shaft.

21. A shoe as defined in claim 18, wherein ends of one said halves have rows of holes and project beyond another said halves, one of said halves being a shorter half located between an elevated edge of said upper part of the shaft and an edge of said lower part of the shaft, the other half being a longer half overlapping an edge of said lower part of the shaft with ends extending to an end of incisions separating said lower part of the shaft from flaps notched thereinto and attached to edges of the incisions.

* * * * *